US005505455A

United States Patent [19]

Kamrath et al.

[11] Patent Number: 5,505,455

[45] Date of Patent: Apr. 9, 1996

[54] GAME WITH SUBTERRANEAN PASSAGEWAY GRID

[75] Inventors: Richard Kamrath, Lomita; George Foster, Signal Hill, both of Calif.

[73] Assignee: Elliot A. Rudell, Torrance, Calif.

[21] Appl. No.: 508,843

[22] Filed: Jul. 28, 1995

[51] Int. Cl.[6] ..... A63F 3/00

[52] U.S. Cl. ..... 273/248; 273/284

[58] Field of Search ..... 273/236, 242, 273/243, 248, 249, 280, 287, 284

[56] References Cited

U.S. PATENT DOCUMENTS

| | | | |
|---|---|---|---|
| 3,709,497 | 1/1973 | Barlow | 273/284 X |
| 3,814,434 | 6/1974 | Robinson | 273/287 X |
| 3,865,381 | 2/1975 | Hayes | 273/280 X |
| 4,422,644 | 12/1983 | Holahan et al. | 273/280 X |
| 4,779,874 | 10/1988 | Dykstra | 273/287 X |
| 5,201,524 | 4/1993 | Csanady | 273/284 X |

*Primary Examiner*—William E. Stoll

*Attorney, Agent, or Firm*—Blakely, Sokoloff, Taylor & Zafman

[57] ABSTRACT

A board game which contains a plurality of tokens that are moved among various slots of a board. The tokens may fall through some of the slots and disappear from the game. The board game includes a first board that has a plurality of slots. The slots are arranged in a number of rows and columns. Each row corresponds to a game space. Each game space has one or more slots. The players take turns spinning a dial and moving a token a number of game spaces along the board. The player may insert the token into any unoccupied slot of the game space. Located below the first board is a second board that can support the tokens. The tokens are supported so that are a portion of the tokens extend above the first board. The second board has a plurality of openings that arranged in an irregular pattern and located adjacent to a number of slots. If the player selects a slot adjacent to an opening, the token falls through the slot and disappears from the game. The second board can be repositioned to vary the location of the openings.

10 Claims, 4 Drawing Sheets

GAME WITH SUBTERRANEAN PASSAGEWAY GRID

BACKGROUND OF THE INVENTION

1. Field of the Invention

The present invention relates to a board game.

2. Description of Related Art

Board games typically contain a number of tokens that are moved about a board. The players take turns moving the tokens along a plurality of spaces printed on a top surface of the board. The number of board spaces moved during each turn is typically determined by rolling dice, spinning a dial or other chance means. A player may win the game by reaching an "end" space, accumulating money, etc.

Parker Bros. marketed a game under the trademark CRACKERS IN MY BED, which contained a plurality of tokens that were inserted into corresponding slots of a game board. Each token had a portion extending above the game board and a portion concealed below the board. The concealed portions of the tokens contained graphic information integral with the game. The tokens could be removed from the slots to view the graphic information.

Gabriel Industries marketed a game under the trademark TOUCHE, which contained a plurality of tokens placed onto a game board that was divided into a matrix of spaces. Each token had a metal panel enclosed by a transparent cover. One side of the metal panel had a color associated with the player. The other side of the panel had a color associated with an opposing player. Some of the board spaces contained magnets which could rotate the panels to the opposing players color. The magnets were hidden from view so that the players would not know which spaces could rotate the token panels to an opposing player's color.

Although board games of the prior art disclose techniques for concealing an element of the game, none of the prior art disclose a game wherein the token disappears from the game board. A disappearing token would provide an element of mystique and surprise to the game. It would be desirable to provide a board game where a player's token disappears from the board.

SUMMARY OF THE INVENTION

The present invention is a board game which contains a plurality of tokens that are moved among various slots of a board. The tokens may fall through some of the slots and disappear from the game. The board game includes a first board that has a plurality of slots. The slots are arranged in a number of rows and columns. Each row corresponds to a game space. Each game space has one or more slots. The players take turns spinning a dial and moving a token a number of game spaces along the board. The player may insert the token into any unoccupied slot of the game space. Located below the first board is a second board that can support the tokens. The tokens are supported so that a portion of the tokens extend above the first board. The second board has a plurality of openings that arranged in an irregular pattern and located adjacent to a number of slots. If the player selects a slot adjacent to an opening, the token falls through the slot and disappears from the game. The second board can be re-positioned to vary the location of the openings.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
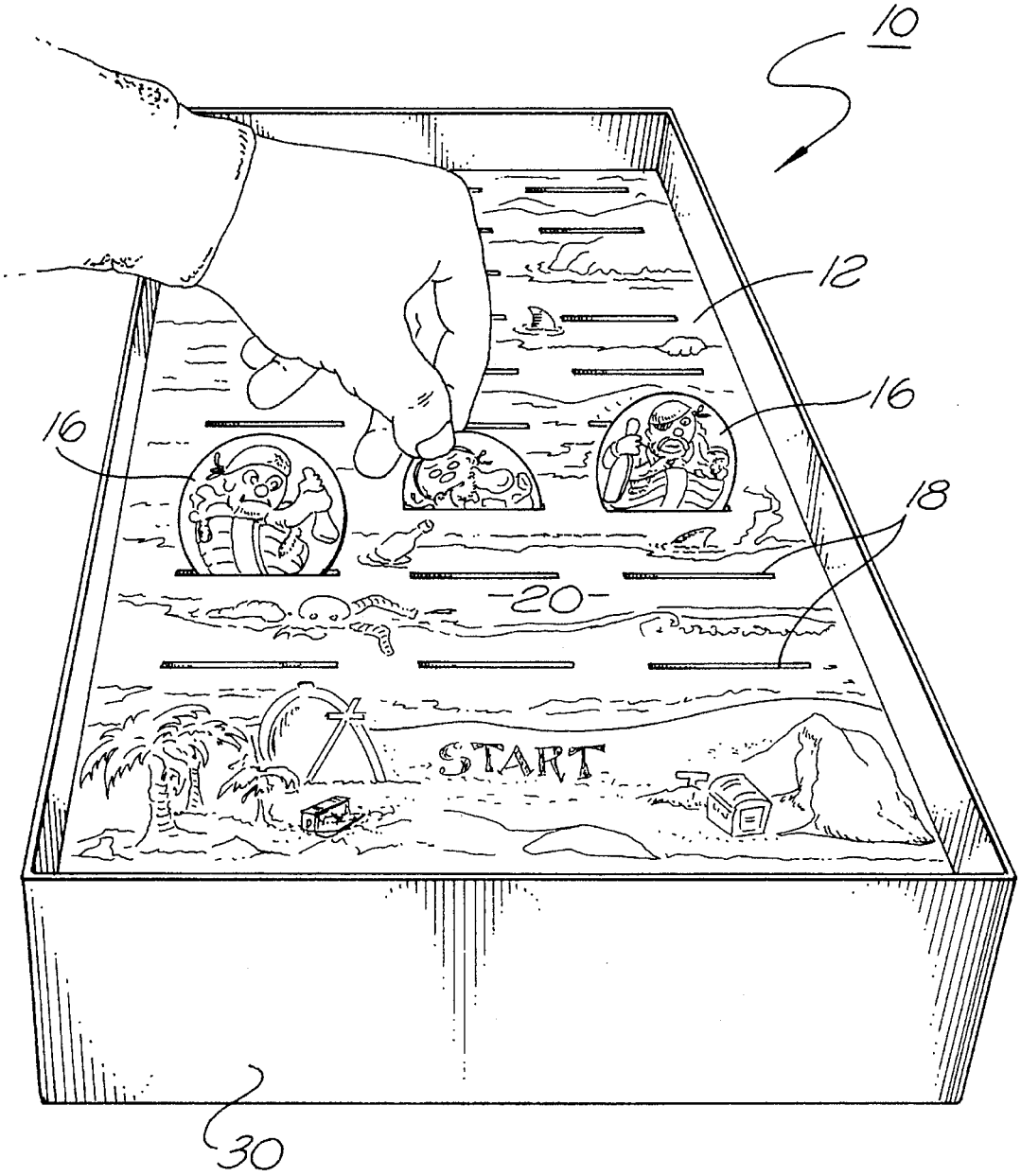
FIG. 1 is a perspective view of a board game of the present invention.
Figure 2:
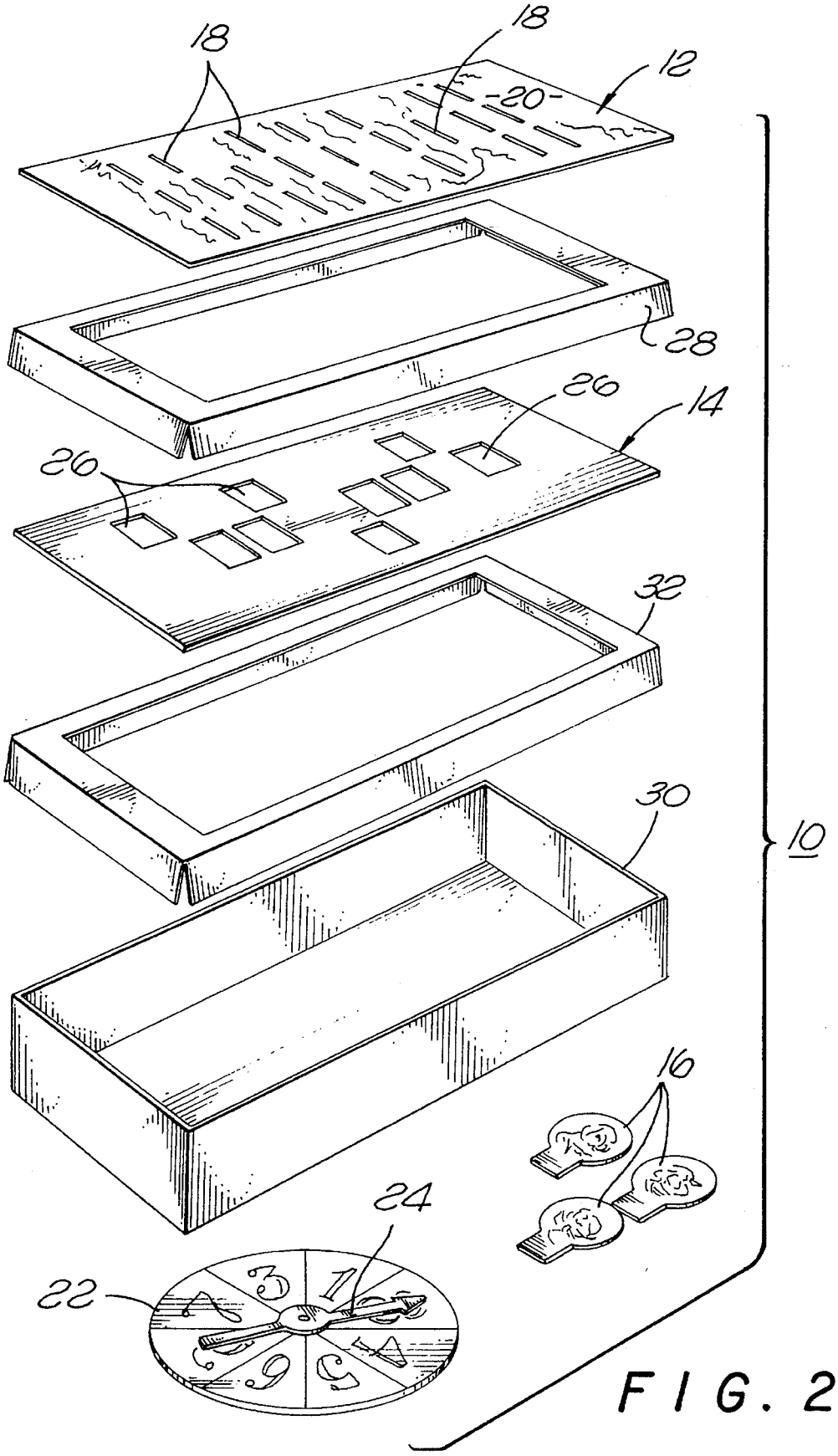
FIG. 2 is an exploded view of the board game.

Referring to the drawings more particularly by reference numbers, FIGS. 1 and 2 show a board game 10 of the present invention. The game 10 includes a first board 12, a second board 14 and a plurality of tokens 16. The tokens 16 are typically flat disk constructed from a cardboard material. The first board 12 has a plurality of slots 18 extending along the board. The tokens 16 can be inserted into the slots 18 by the players of the game so that a portion of the tokens remain above the first board 12. The slots 18 are arranged into a number of rows and columns. Each row may have one or more slots 18.

The first board 12 may have a printed top surface 20 so that each row of slots 18 corresponds to a game space. By way of example, the printed matter may be a depiction of two land portions separated by a body of water. The tokens 16 can also have printed matter that depict "pirate" characters. One end of the first board 12 may have a land portion designated as "start" and the other opposite end of the board 12 may be designated as "end". The players can then move the tokens across the body of water from one land portion (start) to the other land portion (end) of the board. The number of spaces moved by a player during each turn can be determined by spinning a spinner 22 or throwing dice (not shown). The spinner 22 may have a plurality of numbers located about a needle 24.

The second board 14 has a plurality of openings 26. The openings 26 are arranged in an irregular pattern across the board 14. When the game is assembled, the openings 26 are located adjacent to a number of slots 18. When a player inserts a token 16 into a slot 18 that is adjacent to an opening 26, the token 16 falls through the slot 18 and opening 26 and disappears from view.

The second board 14 is separated from the first board 12 by a first spacer 28. The first spacer 28 separates the first board 12 from the second board 14, so that when the tokens 16 are inserted into the slots 18 a portion of the tokens 16 extend from the first surface 20 of the board 12. The second board 14 may also be separated from a box 30 by a second spacer 32. The boards 12 and 14, and spacers 28 and 32 can be placed within the box 30. The box 30 conceals the second board 14 so that the players cannot see the location of the openings 26. The game can be packaged by placing the boards, spacers, dial and tokens into the box 30, and enclosing the box 30 with cover (not shown). The boards, spacers and box can all be constructed from a relatively inexpensive cardboard material.

Figure 3:
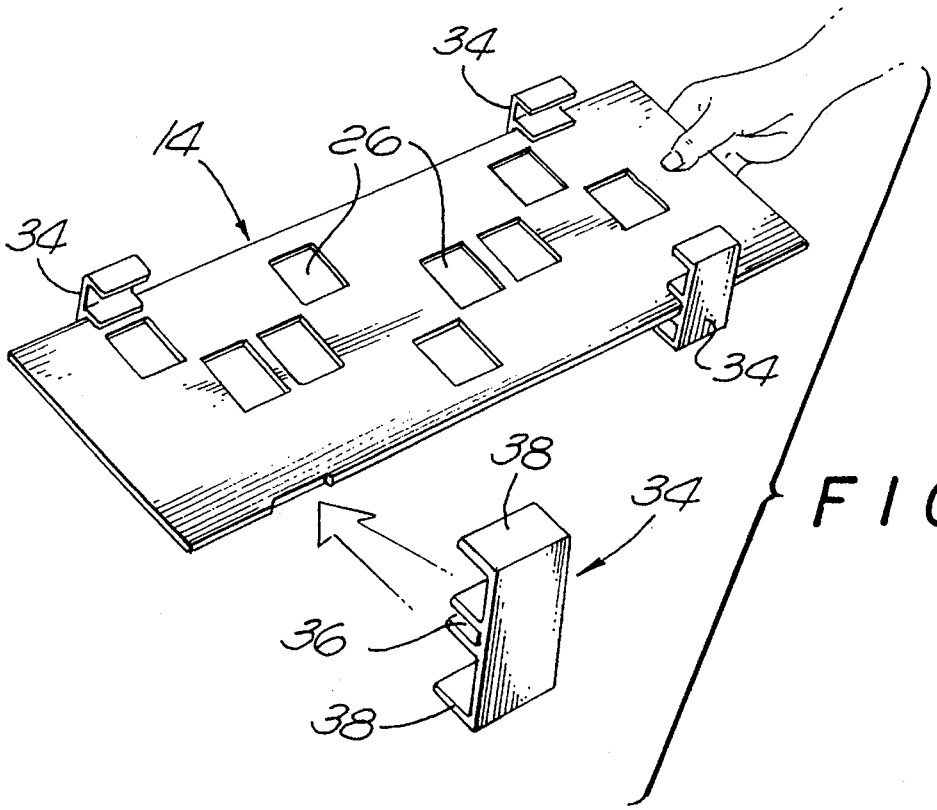
FIG. 3 is a perspective view of an alternate embodiment of the game board.
Figure 4:
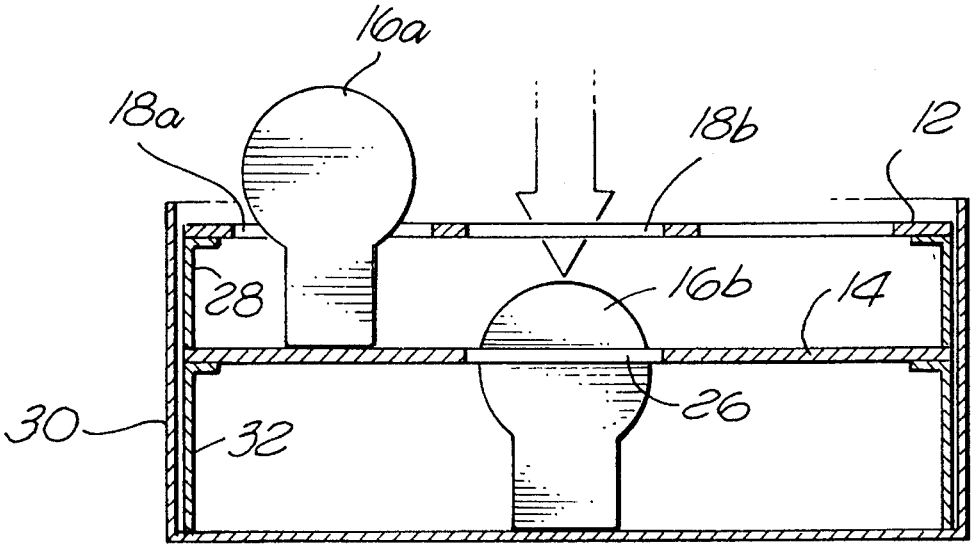
FIG. 4 is a side cross-sectional view showing tokens inserted into slots of the game.

FIG. 3 shows an alternate embodiment, wherein the second board 14 is separated from the first board 12 and box 30 by a plurality of spacers 34. The spacers 34 each have a clip 36 that receives an edge of the second board 14. Each spacer 34 also has a pair of legs 38 that support the boards. To assemble the game, the spacers 34 are clipped onto the second board 14, and placed into the box 30. The first board 12 is then placed on top of the spacers 34. The spacers 34 may be constructed from a hard plastic material to provide a more durable game assembly.

As shown in 4, a player can insert a token **16*a* into a slot 18*b* that does not have an adjacent opening 22 ("non-opening slot"). When inserted into a non-opening slot the token 16*a* is supported by the second board 14 and extends from the first board 12. When a player inserts a token 16*b* into a slot 18*b* that has an adjacent opening 22, the token 16*b* falls through the slot 18*b* and the opening 22, and is located below the top surface of the first board 12. The taken 16*b*** becomes inaccessible and out of the players view.

To play a game, the various components can be taken out of the packaging box 30. The second spacer 32 can be left in, or placed back into the box 30. The second board 14 is placed on top of the second spacer 32, and the first spacer 28 is placed on top of the second board 14. The first board 12 is then placed onto the first spacer 28.

The first player spins the dial 22 to determine a number of spaces that can be moved by a token 16. The player then moves a token the predetermined number of game spaces to a row of slots 18 on the first board 12. The player can insert the token into any unoccupied slot 18 in the row. If the selected slot 18 has an adjacent opening 26 the token 16 will fall through the slot and become "out of play". The sudden disappearance of the token 16 provides an immediate penalty response to an action of the game. The openings 26 are concealed by the box 30 so that the players cannot see which slots are non-opening slots, thereby increasing the intrigue of the game. The players take turns spinning the dial 22 and moving tokens until one player places a token at the opposite end of the first board 12.

Figure 5:
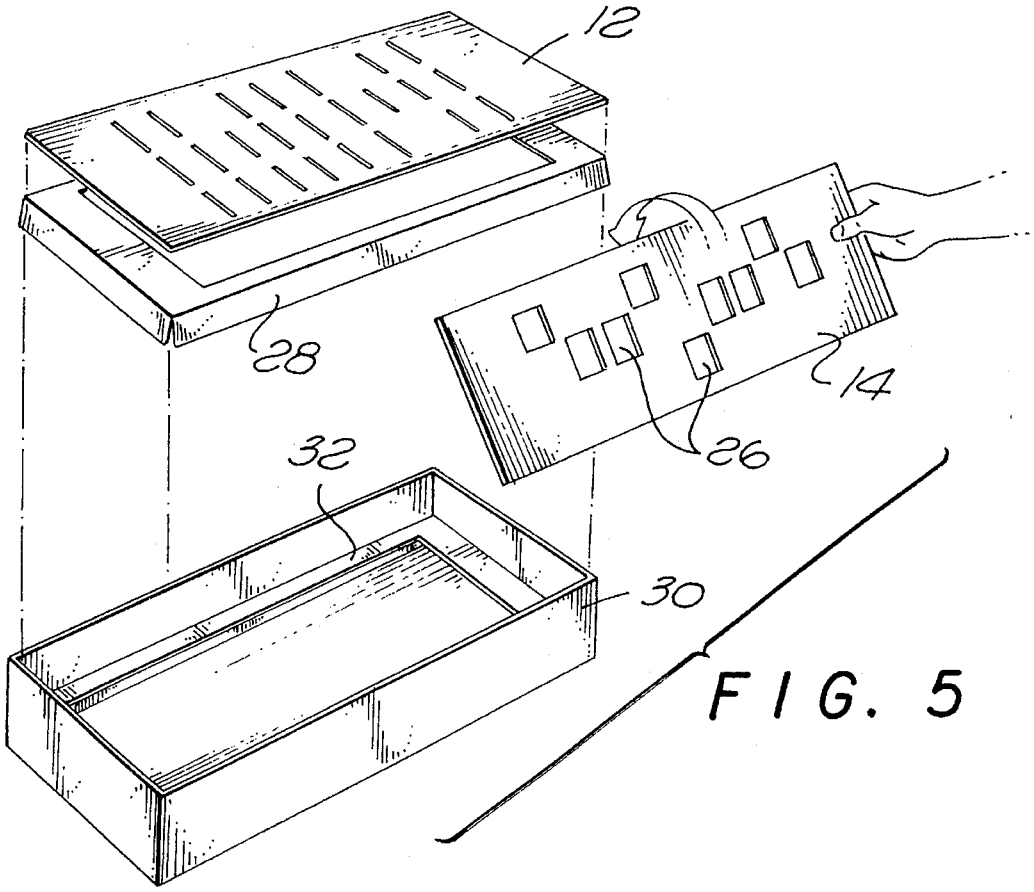
FIG. 5 is an exploded view showing a second board being re-positioned.

As shown in FIG. 5, the game can be repeated by removing the boards 12 and 14, and the first spacer 28. A player can rotate the first board 12 about the longitudinal axis and/or flip the board about the ends to vary the alignment of the openings 26 with the slots 18. The first spacer 28 and first board 12 are then reassembled and the game is repeated. The second board 14 can be turned into one of four positions so that the players cannot memorize the location of the openings 26.

Figure 6:
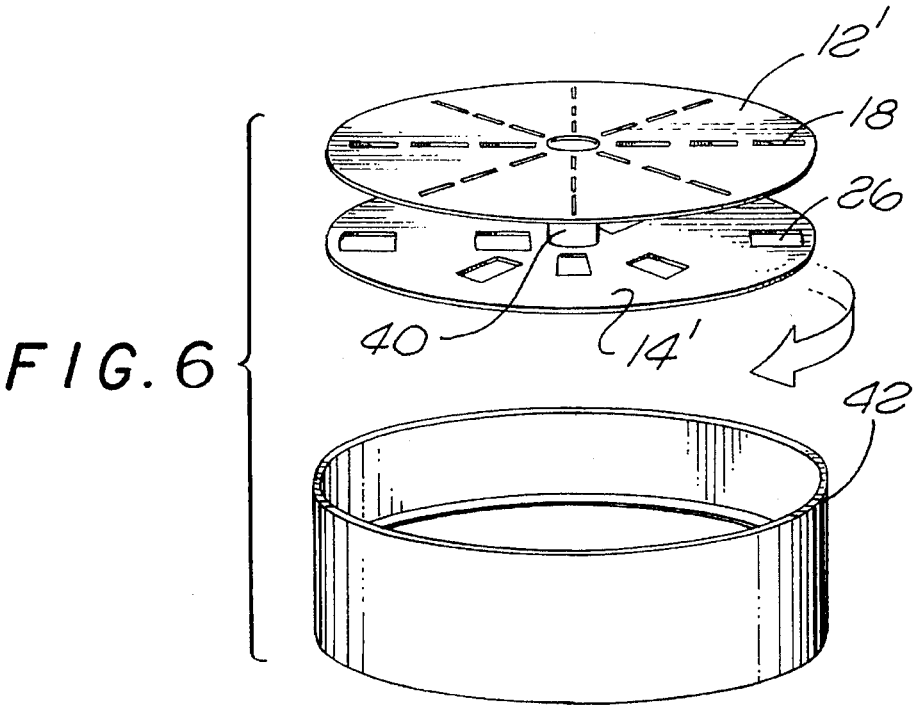
FIG. 6 is a perspective view of an alternate embodiment of the game board.

FIG. 6 shows an alternate embodiment, wherein the second board 14' is pivotally connected to a circular first board 12'. The second board 14' has an irregular pattern of openings 26 that can be aligned with slots 18 of the first board 12'. The boards can be separated by a spacer 40 that has an internal bearing (not shown) which allows the second board 14' to rotate relative to the first board 12'. The boards may have a detent (not shown) that holds the second board 14' in place. The second board 14' is concealed by an enclosure 42. The rotating second board 14' embodiment allows the players to quickly vary the alignment of the openings 26.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A board game, comprising:

a first board that has a plurality of slots, said slots being arranged within a matrix of rows and columns said first board having a first surface and an opposite second surface;

a plurality of tokens that are placed into said slots;

a second board that is located adjacent to said second surface of said first board to support tokens located within a first group of said slots so that a portion of each token extends from said first surface of said first board, said second board having a plurality of openings arranged in an irregular pattern and aligned with a second group of slots, wherein said openings allow tokens to fall through said second group of slots and said openings to remove said tokens from play.

2. The game as recited in claim 1, wherein said second board can be repositioned to realign said openings with said slots.

3. The game as recited in claim 2, wherein said second board can rotate relative to said first board.

4. The game as recited in claim 1, further comprising an enclosure that encloses said second board.

5. The game as recited in claim 4, further comprising a first spacer that separates said first board from said second board.

6. The game as recited in claim 5, further comprising a second spacer that separates said second board from said enclosure.

7. The game as recited in claim 1, further comprising means for determining token movement.

8. The game as recited in claim 1, wherein said slots are arranged in a matrix of rows and columns.

9. A method for playing a game, comprising the steps of:

a) providing a plurality tokens, a first board that has a plurality of slots that can receive said tokens, said slots being arranged within a matrix of rows and columns, and a second board that can support tokens located within a first group of said slots, said second board having a plurality of openings arranged in an irregular pattern, wherein said openings allow tokens to fall therethrough when placed into a second group of slots; and, b) moving a first token a predetermined number of rows along said first board;

c) inserting said first token into a slot of said row, wherein said first token falls through said slot if said slot is adjacent to an opening of said second board, and said first token is supported by said second board if said slot is not adjacent to an opening.

10. The method as recited in claim 9, wherein the predetermined number of rows recited in step (b) is determined by spinning a dial.

* * * * *